US005382501A

United States Patent [19]

Inoie

[11] Patent Number: 5,382,501

[45] Date of Patent: Jan. 17, 1995

[54] SILVER HALIDE COLOR PHOTOGRAPHIC LIGHT-SENSITIVE MATERIAL

[75] Inventor: Hiroshi Inoie, Hino, Japan

[73] Assignee: Konica Corporation, Tokyo, Japan

[21] Appl. No.: 975,277

[22] Filed: Nov. 12, 1992

[30] Foreign Application Priority Data

Dec. 24, 1991 [JP] Japan ..... 3-341166

[51] Int. Cl.[6] ..... G03C 1/46

[52] U.S. Cl. ..... 430/506; 430/502; 430/503; 430/504; 430/567

[58] Field of Search ..... 430/506, 567, 502, 503, 430/504

[56] References Cited

U.S. PATENT DOCUMENTS

| | | | |
|---|---|---|---|
| 3,271,157 | 9/1966 | McBride | 430/599 |
| 3,531,289 | 9/1970 | Wood | 430/569 |
| 3,574,628 | 4/1971 | Jones | 430/567 |
| 4,511,648 | 4/1985 | Yamashita et al. | 430/506 |
| 4,670,375 | 6/1987 | Michure et al. | 430/506 |
| 4,952,485 | 8/1990 | Shibahara et al. | 430/506 |
| 5,118,597 | 6/1992 | Mihayashi et al. | 430/544 |

FOREIGN PATENT DOCUMENTS

| | | |
|---|---|---|
| 0451859 | 10/1991 | European Pat. Off. . |
| 63-024237 | 2/1988 | Japan . |

*Primary Examiner*—Charles L. Bowers, Jr.

*Assistant Examiner*—Geraldine Letscher

*Attorney, Agent, or Firm*—Frishauf, Holtz, Goodman & Woodward

[57] ABSTRACT

Disclosed is a silver halide color photographic light-sensitive material comprising a support having thereon a red-sensitive layer, a green-sensitive layer and a blue-sensitive layer, wherein said blue-sensitive layer comprises three or more silver halide emulsion layers, wherein the difference between the average silver iodide content of said emulsion contained in the highest sensitivity layer of said blue-sensitive layers and the average silver iodide content of said emulsion contained in the lowest sensitivity layer of said blue-sensitive layers is represented by Equation 1, and the sum total of the silver halides contained in said silver halide color light-sensitive material is not more than 9.0 g/m$^2$ in terms of metal silver;

Equation 1

Average silver iodide content of the highest sensitivity layer −average iodide content of the lowest sensitivity layer≦6 mol %.

A silver halide color photographic light-sensitive material according to the invention is improved in graininess and in processing stability.

5 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material excellent in processing stability and improved in graininess.

BACKGROUND OF THE INVENTION

With the growing importance of environmental protection, waste liquid treatment, smell of processing solutions, and toxicity of processing agents to the human body have become serious problems in the latest photographic technology.

Under the circumstances, various improvements have been made and practiced in processing solutions (agents) and replenishing amounts of processing solutions to solve these problems, and at the same time, rapid-processing to shorten the processing time has come to be extensively practiced.

On the other hand, a higher sensitivity and a higher image quality are increasingly required of silver halide photographic light-sensitive materials (hereinafter occasionally referred to as light-sensitive materials).

And it has become important to make further improvements on light-sensitive materials as much as possible for the use in such a shortened processing time, in addition to the maintenance of the existing photographic properties.

It is well known in the art that decreasing the silver iodide content improves of a silver halide used in light-sensitive materials raises developability and accelerates desilverization.

Therefore, color photographic light-sensitive materials have been studied and improved on silver halide compositions, methods of forming thinner coating films, types and amounts of couplers and other additives in order to shorten the processing time and minimize the amount of processing solution to be replenished.

These means are useful in shortening the processing time, but insufficient in reducing the amount of a processing solution to be replenished and, therefore, these can hardly provide stable photographic properties when replenishment is small. And, even when thinner component layers are provided or two-equivalent couplers are used for the improvement of image sharpness and processability, contrary effects such as deterioration in graininess and variance in processing are liable to be produced.

For the foregoing reasons, development of a new technique which can constantly provide a high image quality is strongly demanded.

SUMMARY OF THE INVENTION

Accordingly, the object of the invention is to provide a silver halide color photographic light-sensitive material excellent in processing stability and improved in graininess.

The above object of the invention is attained by a silver halide color photographic light-sensitive material comprising a support having thereon a red-sensitive layer, a green sensitive layer and a blue-sensitive layer, among which the blue-sensitive layer comprises three or more silver halide emulsion layers different in sensitivity, wherein the average silver iodide content of the silver halide emulsion contained in the highest sensitivity layer of said blue-sensitive layers and the average silver iodide content of the silver halide emulsion contained in the lowest sensitivity layer have a relation shown by the following equation, and the sum total of the silver halides contained in said silver halide color light-sensitive material is not more than 9.0 g/m$^2$ in terms of metal silver.

Average silver iodide content in the highest sensitivity layer—average silver iodide content in the lowest sensitivity layer$\leqq$6 mol %)

DETAILED DESCRIPTION OF THE PREFERRED EMBODIMENT

The invention is hereinafter described in detail.

In the invention, it is preferable that the blue-sensitive emulsion layer be composed of three or more layers different in sensitivity. In the invention, the difference between the average silver iodide content of the silver halide emulsion contained in the highest sensitivity layer of the blue-sensitive layers and the average silver iodide content of the silver halide emulsion contained in the lowest sensitivity layer is not more than 6 mol % and preferably 0 to 4.5 mol %.

In the invention, the total iodide content of silver halide grains was determined by X-ray fluorometry (WDX) in the following procedure.

1. Prescribed amounts of high-purity powder AgBr and AgI were weighed out and dissolved in a potassium cyanide solution.

2. Then, the above solution of known concentration was sampled with a microcylinder and dropped onto a spot filter paper.

3. After drying the sample on the filter paper, the fluorescent X-ray intensities of Ag and I were measured by subjecting the sample to WDX. An analytical curve was obtained from the correlation between the ratio of the intensities and the concentration of AgI.

4. Subsequently, emulsion grains to be measured were treated with an enzyme to decompose the gelatin contained. After centrifuging, the supernatant was removed.

5. The emulsion grains separated as a precipitate were dissolved in the potassium cyanide solution and subjected likewise to WDX to measure the fluorescent X-ray intensity of AgI. The iodide content of the sample was determined by comparing the intensity with the analytical curve.

In making the measurement by WDX, measurement was repeated two times to raise the accuracy using an X-ray Fluorometry System 3080 made by Rigaku Denki Kogyo Co.

The sum total of silver halides contained in the light-sensitive material of the invention is not more than 9.0 g/m$^2$, preferably 3.5 to 8.5 g/m$^2$ and especially 4.0 to 8.0 g/m$^2$ in terms of metal silver. The amount of silver halide can be measured by X-ray fluorometry.

Next, the silver halide emulsion to form a spectrally sensitive layer is described. As the emulsion for the silver halide color photographic light-sensitive material according to the invention, a monodispersed silver halide emulsion is preferred. Particularly preferred is a monodispersed silver halide emulsion comprising mainly twin silver halide crystal grains.

The term "a monodispersed silver halide emulsion" used here means a silver halide emulsion in which the weight of silver halide grains having grain sizes within the limits of average grain size d$\pm$20% is not less than 70%, preferably not less than 80% and especially not less than 90% of the weight of the total silver halide grains.

Average grain size d is defined as grain size $d_i$, at which the product of frequency $n_i$ of grains having grain size $d_i$ and $d_i^3$ namely $n_i \times d_i^3$ gives the maximum value.

(Three significant figures, the last figure is one rounded to the nearest whole number.) The term "a grain size" means a diameter of a circular image converted in the same area from a projected image of a grain. Such a grain size can be determined, for example, by the steps of photographying a grain on an electron microscope at a magnification of 10,000 to 50,000 and measuring the diameter or projected area of the grain on the print. (The number of grains for measurement is not less than 1000 selected at random.)

When the extent of grain size distribution is defined by standard deviation of grain sizes/average grain size×100 (%), a highly monodispersed emulsion particularly preferred in the invention is that which comprises grains having a distribution extent of not more than 20%, especially not more than 15%.

The average grain size is given as an arithmetic mean as shown below, provided that the measurement of grain sizes is made according to the procedure described above.

$$\Sigma d_i n_i / \Sigma n_i$$

Preferably, the silver halide emulsion according to the invention comprises silver iodobromide having an average silver iodide content of 4 to 20 mol %. In one particularly preferred embodiment, the emulsion comprises silver iodobromide having an average silver iodide content of 5 to 15 mol %.

The silver halide emulsion of the invention may contain silver chloride within the range not harmful to the effect of the invention.

The silver halide emulsion of the invention may comprise regular crystal grains such as cubes, tetradecahedrons or octadecahedrons; twinned crystal grains such as tabular grains; or mixtures thereof.

When tabular twinned crystal grains are used, it is desirable that the sum of the projected areas of grains having a diameter to thickness ratio of 1 to 20 amount to 60% or more of the sum of the total grains projected areas (the diameter used here is a diameter of a circular image converted in the same area from a projected image of a grain). This diameter to thickness ratio is more desirably in the range of 1.2 to 8.0, most desirably in the range of 1.5 to 5.0.

A monodispersed emulsion comprising regular crystal grains can be prepared by referring to, for example, the methods disclosed in Japanese Pat. O.P.I. Pub. Nos. 177535/1984, 138538/1985, 52238/1984, 143331/1985, 35726/1985, 258536/1985 and 14636/1986.

A monodispersed emulsion comprising twinned crystal grains can be prepared by referring to, for example, the method of growing cubic seed grains disclosed in Japanese Pat. O.P.I. Pub. No. 14636/1986. In growing grains, it is preferable to add an aqueous solution of silver nitrate and an aqueous halide solution by the double-jet method.

Iodine may also be added to the reaction system in the form of silver iodide. The addition rate is such as does not form new nuclei or broaden the grain size distribution by the Ostwald ripening; that is, the addition is made preferably within the range of 30 to 100% of a critical addition rate at which new nuclei are formed.

The silver halide emulsion of the invention comprises grains having a high silver iodide content phase internally. The silver iodide content in such a high silver iodide content phase is 15 to 45 mol %, preferably 20 to 42 mol % and especially 25 to 40 mol %.

The silver halide grains, which have a high silver iodide content phase internally, have the structure in which the high silver iodide content phase is covered with a low silver iodide content phase having a lower silver iodide content.

In the low silver iodide content phase which forms the outermost phase, the average silver iodide .content is preferably not more than 6 mol %, especially 0 to 4 mol %. A silver iodide content phase (intermediate phase) may be further provided between the outermost phase and the high silver iodide content phase. The silver iodide content in such an intermediate phase is preferably 10 to 22 mol %, especially 12 to 20%.

The difference in silver iodide content between the outermost phase and the intermediate phase, and that between the intermediate phase and the internally high silver iodide content phase, are preferably not less than 6 mol % and especially not less than 10 mol %, respectively.

In the above mode, there may be formed another silver halide phase at the center of the internally high silver iodide content phase, between the internally high silver iodide content phase and the intermediate phase, or between the intermediate phase and the outermost phase.

The volume of the outermost phase is preferably 4 to 70%, especially 10 to 50% of the whole grain. The volume of the high silver iodide content phase is desirably 10 to 80%, more desirably 20 to 50% and most desirably 20 to 45% of the whole grain. The volume of the intermediate phase is preferably 5 to 60% and especially 20 to 55% of the whole grain.

Each of these phases may be a single phase having a uniform composition, a group of phases comprising a plurality of phases each having a uniform composition and thereby the composition changes stepwise, a continuous phase in which the composition changes continuously, or a mixture thereof.

In another mode of the silver halide emulsion of the invention, silver iodide localized in grains does not form a uniform phase, and the silver iodide content continuously changes from the center of a grain to its periphery. In this case, it is preferable that the silver iodide content flatly decrease in a grain from the point where the silver iodide content is the highest to the periphery of the grain.

The silver iodide content at the point where the silver iodide content is the highest is preferably 15 to 45 mol %, especially 25 to 40 mol %. And the silver iodide content in the peripheral portion of the grain is preferably not more than 6 mol %; in a particularly preferred mode, the peripheral portion comprises silver iodobromide containing 0 to 4 mol % silver iodide.

The silver halide emulsion of the invention may be mixed for use with other emulsions within a range not harmful to the effect of the invention.

When silver halide grains (A) containing two or more kinds of silver halides and comprising mainly monodispersed twinned crystals are prepared according to the method for manufacturing silver halide emulsion of the invention, it is required to employ (1) monodispersed silver halide grains midway to the grown stage of (A) (referred to as seed grains), (2) silver halide grains having a solubility product smaller than that of seed grains (B) (referred to as AgX fine grains), and (3) a supply AgX element to be fed for depositing mixed crystals on seed grains in conjunction with AgX fine grains.

The monodispersed seed grains used in the invention comprise mainly twinned crystal grains.

The wording "comprise mainly twinned crystal grains" means that twinned crystal grains amount to 50% or more, preferably 80% or more and especially 95% or more of the total number of crystal grains.

These monodispersed twinned seed grains can be obtained by ripening multiple-twinned nucleus grains into spherical twinned seed grains in the presence of a silver halide solvent, as is described in Japanese Pat. O.P.I. Pub. No. 6643/1986.

That is, the preparation of seed grains comprises the following processes (a) and (b):

(a) the nucleus grain forming process, in which the pBr of a mother liquor is kept at 2.0 to −0.7 over a half or more than half of the period of this process started with the formation of a silver halide precipitate containing 0 to 5 mol % silver iodide.

(b) the seed grain forming process which follows the nucleus grain forming process, in which substantially monodispersed spherical silver halide grains are formed in a mother liquor containing a silver halide solvent in an amount, of $10^{-5}$ to 2.0 moles per mole of silver halide.

The term "a mother liquor" means a liquor used as a medium to make up a silver halide emulsion into a photographic emulsion (including a silver halide emulsion itself).

The silver halide grains formed in the above nucleus grain forming process are twinned crystal grains of silver iodobromide containing 0 to 5 mol % silver iodide.

In the invention, twinned nucleus grains can be obtained by adding to an aqueous solution of protective colloid a water soluble silver salt, or a water soluble silver salt and a water soluble halide in combination, while keeping the bromine ion concentration in the aqueous solution of protective colloid at 0.01 to 5 mol/l (or the pBr of the solution at 2.0 to −0.7), preferably 0.03 to 5 mol/l (pBr at 1.5 to −0.7) over a period of first one-half or more of the nucleus grain forming process.

The nucleus grain forming process in the invention is defined as a process before the seed grain forming process and may cover not only a period between the time when addition of a water soluble silver salt to a protective colloid solution is started and the time when formation of new crystal nucleus substantially terminates, but also a subsequent period in which grains are grown.

In the invention, the size distribution of nucleus grains is not limited and may be either monodispersion or polydispersion. The term "polydispersion" used here means those having a variation coefficient of grain sizes (the same as the above size distribution) not less than 25%.

In the nucleus grains of the invention, twinned crystal grains amount to, in number, desirably at least 50%, more desirably 70% or more, and most desirably 90% or more of the total nucleus grains.

Next, the the seed grain forming process is described, in which seed grains comprising monodispersed spherical grains are formed by ripening nucleus grains obtained in the nucleus grain forming process in the presence of a silver halide solvent.

Ripening in the presence of a silver halide solvent (hereinafter simply referred to as ripening) is considered to be different from the Ostwald ripening, in which small grains dissolve and contrarily large grains grow and thereby the grain size distribution is broadened when large grains and small grains coexist. In one preferable mode of ripening nucleus grains obtained in the nucleus grain forming process into seed grains, spherical seed grains of substantial monodispersion can be obtained by ripening, in the presence of $10^{-5}$ to 2.0 mol/mol AgX of a silver halide solvent, an emulsion mother liquor which has undergone the nucleus grain forming process to form twinned nucleus grains by use of a silver halide having a silver iodide content of 0 to 5 mol %. Substantial monodispersion means that the extent of distribution defined above is not more than 25%.

The term "substantially spherical grain" means that when a silver halide grain is observed on an electron micrograph, the grain has {111} faces or {100} faces rounded to the extent of preventing clear discrimination of these faces, and that when three-dimensional axes crossing at right angles to one another are set at a point near the gravity center of the grain, the ratio of the maximum grain diameter L in the directions longitudinal, transverse and perpendicular to the plane image of the grain to the minimum grain diameter 1 in the same directions (C=L/l) is 1.0 to 2.0, preferably 1.0 to 1.5.

Further, in the invention, such spherical grains amount to 60% or more, preferably 80% or more and especially almost all the seed grains in number.

Silver halide solvents usable in the seed grain forming process of the invention include (a) the organic thioethers disclosed in U.S. Pat. Nos. 3,271,157, 3,531,289, 3,574,628, Japanese Pat. O.P.I. Pub. Nos. 1019/1979, 158917/1979 and Japanese Pat. Exam. Pub. No. 30571/1983; (b) the thiourea derivatives disclosed in Japanese Pat. O.P.I. Pub. Nos. 82408/1978, 29829/1980, 77737/1980; (c) the AgX solvents having a thiocarbonyl group sandwiched between an oxygen or sulfur atom and a nitrogen atom, which are disclosed in Japanese Pat. O.P.I. Pub. No. 144319/1978; (d) the imidazoles disclosed in Japanese Pat. O.P.I. Pub. No. 100717/1979; (e) sulfites; (f) thiocyanates; (g) ammonia; (h) the hydroxyalkylsubstituted ethylenediamines disclosed in Japanese Pat. O.P.I. Pub. No. 196228/1982; (i) the substituted mercaptotetrazoles disclosed in Japanese Pat. O.P.I. Pub. No. 202531/1982; (j) water soluble bromides; and (k) the benzimidazole derivatives disclosed in Japanese Pat. O.P.I. Pub. No. 54333/1983. Typical examples of these silver halide solvents in each of groups (a) to (k) are shown below.

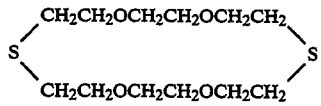
(a)

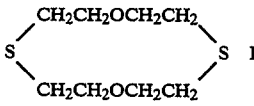
$HOCH_2CH_2SCH_2CH_2SCH_2CH_2OH$

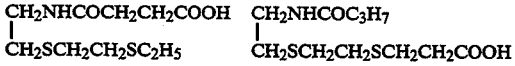

-continued

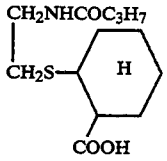

(b)

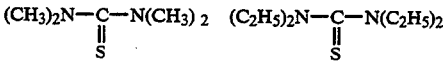

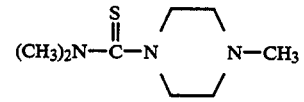

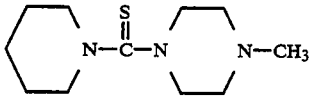

(c)

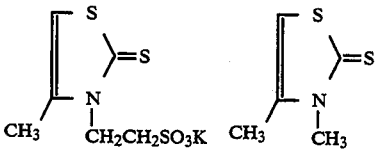

(d)

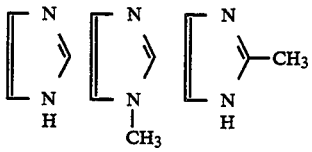

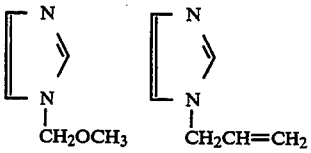

(e) $K_2SO_3$, $Na_2SO_3$ (f) $NH_4SCN$, KSCN (g) $NH_3$ (h) $(HOCH_2CH_2)_2NCH_2CH_2N(CH_2CH_2OH)_2$ $(CH_3CHCH_2)_2NCH_2CH_2N(CH_2CHCH_3)_2$ (OH, OH)

$(C_2H_5)_2NCH_2CH_2N(CH_2CH_2OH)_2$ $(C_2H_5CHCH_2)_2NCH_2CH_2N(CH_2CHC_2H_5)_2$ (OH, OH)

(i)

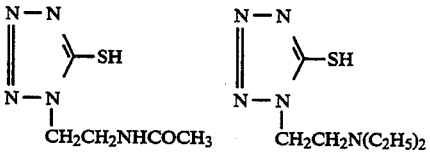

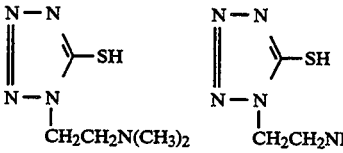

-continued

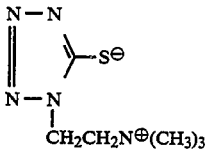

(j) NaBr, $NH_4Br$, KBr (k)

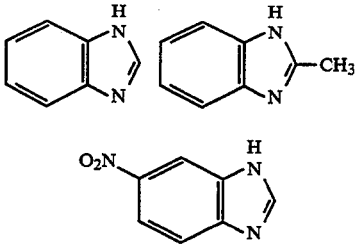

These solvents may be used in combination of two or more types. Preferred solvents are thioethers, thiocyanates, thioureas, ammonia and bromides; combination of ammonia and bromides is particularly preferred.

These solvents are used in an amount of $10^{-5}$ to 2 moles per mole of silver halide.

The ripening is preferably carried out under pH conditions of 3 to 13 and 30° to 70° C., especially, under pH conditions of 6 to 12 and 35° to 50° C.

In one preferred embodiment of the invention, an emulsion comprising favorable seed grains is obtained by performing the ripening under pH conditions of 10.8 to 11.2 and 35° to 45° C. for a period of 30 sec to 10 min, using ammonia (0.4 to 1.0 mol/l) and potassium bromide (0.03 to 0.5 mol/l) in combination.

In the seed grain forming process of the invention, there may be added a water soluble silver salt for the purpose of controlling the ripening.

The silver halide grains (B) having a solubility product smaller than that of the seed grains and the supply AgX element are selected according to the silver halide composition, typical examples of such selection are as follows:

TABLE 1

| Silver Halide Grains (A) | AgX Fine Grains | Supply AgX Element |
|---|---|---|
| AgBrI | AgI | AgBr fine grains, or solutions of a soluble silver salt and a soluble bromide |
| AgBrCl | AgBr | AgCl fine grains, or solutions of a soluble silver salt and a soluble chloride |
| AgClI | AgI | AgCl fine grains, or solutions of a soluble silver salt and a soluble chloride |

The AgX fine grains are used in an amount to supply at least 50%, preferably 70% or more and especially 90% or more of a halogen element of which silver salt is less soluble in the group of halide elements to form silver halide grains (A).

In the method for making the silver halide emulsion of the invention, seed grains are advantageously grown when the AgX fine grains are present together with a water soluble protective colloid as constituents of a mother liquor before the addition of the supply AgX element. Then, the AgX fine grains and the supply AgX element are continuously fed to the mother liquor.

This continuous feeding includes a process to add the AgX fine grains and the supply AgX element correspondingly to the consumption of the AgX fine grains and the supply AgX element contained in the mother liquor, and such addition may be made intermittently or stepwise.

The supply AgX element is preferably a combination of a soluble silver salt and a soluble halide; typically, such a soluble salt is silver nitrate, and such a soluble halide bromide is potassium bromide or ammonium bromide. The supply AgX element may contain a portion of the halide element fed by the AgX fine grains, within a range not harmful to the performance.

Preferably, the AgX fine grains are of monodispersion. Their average grain sizes are not necessarily very fine, but usually not larger than 0.7 μm, preferably in a range of 0.3 to 0.005 μm.

In the process of growing the seed grains by use of the AgX fine grains and the supply AgX element, an optimum addition rate is selected so as to prevent new nuclei from precipitating and grown grains from undergoing the Ostwald ripening. Further, it is preferable to use an ammoniacal silver nitrate in the preparation of the supply AgX element.

In the above seed grain growing process, the temperature of a mother liquor is 10° to 80° C. preferably 20° to 75° C.; the pAg is 6 to 11, preferably 7.5 to 10.5; and the pH is 5 to 11, preferably 5.5 to 10.

In preparing a silver halide emulsion (including a seed emulsion), there may be added, besides gelatin, a substance capable of being adsorbed by silver halide grains. Examples thereof include those compounds and heavy metal ions which are used as sensitizing dyes, antifoggants or stabilizers in the art. Examples of such absorbants can be seen in Japanese Pat. O.P.I. Pub. No. 7040/1987. In order to decrease fogging of an emulsion and improve the aging stability, it is preferable to add at least one of such antifoggants and stabilizers in the process of preparing a seed emulsion.

Among the antifoggants and stabilizers, heterocyclic mercapto compounds and/or azaindene compounds are particularly preferable. Typical examples of such heterocyclic mercapto compounds and azaindene compounds are described in Japanese Pat. O.P.I. Pub. No. 41848/1988.

The addition amount of these heterocyclic mercapto compounds and azaindene compounds is not restrictive, but preferably $1\times10^{-5}$ to $3\times10^{-2}$ mol/mol AgX, especially $1\times10^{-5}$ to $3\times10^{-3}$ mol/mol AgX. This addition amount is properly selected according to production conditions of silver halide grains, average sizes of silver halide grains and types of the above compounds.

A finished emulsion provided with the prescribed grain conditions is subjected to desalting. This desalting may be made by the method disclosed in Japanese Pat. Appl. Nos. 81373/1987 and 9047/1988 which employs gelatin flocculants used in desalting of silver halide seed grains; the noodle-washing method; or the coagulation method which employs inorganic salts comprising polyvalent anions such as sodium sulfate, anionic surfactants, or anionic polymers such as polystyrenesulfonates.

In the invention, the silver halide emulsion is subjected to physical ripening, chemical ripening and spectral sensitization before it is used. Additives used in these processes are described in Research Disclosure Nos. 17643, 18716 and 308119 (hereinafter abbreviated as RD17643, RD18716 and RD308119, respectively).

The locations of the relevant descriptions are as follows:

| [Item] | [Page of RD308119] | [RD17643] | [RD18716] |
|---|---|---|---|
| Chemical sensitizer | 996 III Sec. A | 23 | 648 |
| Spectral sensitizer | 996 IV Sec. A, B, C, D, E~J | 23–24 | 648–9 |
| Supersensitizer | 996 IV Sec. A–E, J | 23–24 | 648–9 |
| Antifoggant | 998 VI | 24–25 | 649 |
| Stabilizer | 998 VI | — | — |

Conventional photographic additives usable in the invention are also described in the above numbers of Research Disclosure.

The locations of the relevant descriptions are as follows:

| [Item] | [Page of RD308119] | [RD17643] | [RD18716] |
|---|---|---|---|
| Anti-color-mixing agent | 1002 VII Sec. I | 25 | 650 |
| Dye image stabilizer | 1001 VII Sec. J | 25 | — |
| Whitening agent | 998 V | 24 | — |
| UV absorbent | 1003 VIII Sec. C XIII Sec. C | 25–26 | — |
| Light absorbent | 1003 VIII | 25–26 | — |
| Light scattering agent | 1003 VIII | — | — |
| Filter dye | 1003 VIII | 25–26 | — |
| Binder | 1003 IX | 26 | 651 |
| Antistatic agent | 1006 XIII | 27 | 650 |
| Hardener | 1004 X | 26 | 651 |
| Plasticizer | 1006 XII | 27 | 650 |
| Lubricant | 1006 XII | 27 | 650 |
| Surfactant, coating aid | 1005 XI | 26–27 | 650 |
| Matting agent | 1007 XVI | — | — |
| Developer (contained in light-sensitive material) | 1011 XX Sec. B | — | — |

Various couplers can be used in the invention, typical examples of such couplers are also described in the above numbers of Research Disclosure. The locations of the relevant descriptions are as follows:

| [Item] | [Page of RD308119] | [RD17643] |
|---|---|---|
| Yellow coupler | 1001 VII Sec. D | VII Sec. C–G |
| Magenta coupler | 1001 VII Sec. D | VII Sec. C–G |
| Cyan coupler | 1001 VII Sec. D | VII Sec. C–G |
| Colored coupler | 1002 VII Sec. G | VII Sec. G |
| DIR coupler | 1001 VII Sec. F | VII Sec. F |
| BAR coupler | 1002 VII Sec. F | |
| Other useful group releasing coupler | 1001 VII Sec. F | — |
| Alkali-soluble Coupler | 1001 VII Sec. E | — |

Among these couplers usable in the invention, cyan couplers are contained in a red-sensitive layer.

Preferred cyan couplers are naphthol type couplers and phenol type couplers.

As magenta couplers contained in a green-sensitive layer, conventional 5-pyrazolone type couplers, pyrazolobenzimidazole type couplers, pyrazolotriazole type couplers and open-chain acylacetonitrile type couplers are preferably used.

As yellow couplers contained in a blue-sensitive layer, acylacetanilide type couplers are preferably used; of them, benzoylacetanilide type couplers and pivaloylacetanilide type couplers are particularly preferable.

The light-sensitive material of the invention can be processed in the usual manners described on pages 28–29 of RD17643, page 647 of RD18716 and in section VII of RD308119.

EXAMPLES

Typical examples of the invention are described hereunder, but the embodiment of the invention is not limited to these examples.

In all the following examples, the addition amount to a silver halide photographic light-sensitive material is given in grams per square meter unless otherwise indicated. The amount of silver halides and colloidal silver is given in an amount of silver present. The amount of sensitizing dyes is shown in moles per mole of silver.

EXAMPLE 1

Sample 101, a multilayered color photographic light-sensitive material, was prepared by forming the following layers in order on a triacetylcellulose support.

| Sample 101 | |
|---|---|
| 1st layer: antihalation layer | |
| Black colloidal silver | 0.16 |
| UV absorbent (UV-1) | 0.20 |
| High boiling solvent (Oil-1) | 0.16 |
| Gelatin | 1.23 |
| 2nd layer: intermediate layer | |
| High boiling solvent (Oil-1) | 0.17 |
| Gelatin | 1.27 |
| 3rd layer: low-speed red-sensitive layer | |
| Silver iodobromide emulsion (Em-1) | 0.21 |
| Silver iodobromide emulsion (Em-2) | 0.50 |
| Sensitizing dye (SD-1) | $2.8 \times 10^{-5}$ |
| Sensitizing dye (SD-2) | $1.9 \times 10^{-4}$ |
| Sensitizing dye (SD-3) | $1.9 \times 10^{-4}$ |
| Sensitizing dye (SD-4) | $1.0 \times 10^{-4}$ |
| Cyan coupler (C-1) | 0.70 |
| Cyan coupler (C-2) | 0.14 |
| Colored cyan coupler (CC-1) | 0.021 |
| DIR compound (D-1) | 0.020 |
| High boiling solvent (Oil-1) | 0.53 |
| Gelatin | 1.30 |
| 4th layer: medium-speed red-sensitive layer | |
| Silver iodobromide emulsion (Em-2) | 0.27 |
| Silver iodobromide emulsion (Em-3) | 0.62 |
| Sensitizing dye (SD-1) | $2.3 \times 10^{-4}$ |
| Sensitizing dye (SD-2) | $1.2 \times 10^{-4}$ |
| Sensitizing dye (SD-3) | $1.6 \times 10^{-5}$ |
| Sensitizing dye (SD-4) | $1.2 \times 10^{-4}$ |
| Cyan coupler (C-1) | 0.15 |
| Cyan coupler (C-2) | 0.18 |
| Colored cyan coupler (CC-1) | 0.030 |
| DIR compound (D-1) | 0.013 |
| High boiling solvent (Oil-1) | 0.30 |
| Gelatin | 0.93 |
| 5th layer: high-speed red-sensitive layer | |
| Silver iodobromide emulsion (Em-4) | 1.27 |
| Sensitizing dye (SD-1) | $1.3 \times 10^{-4}$ |
| Sensitizing dye (SD-2) | $1.3 \times 10^{-4}$ |
| Sensitizing dye (SD-3) | $1.6 \times 10^{-4}$ |
| Cyan coupler (C-2) | 0.12 |
| Colored cyan coupler (CC-1) | 0.013 |
| High boiling solvent (Oil-1) | 0.14 |
| Gelatin | 0.91 |
| 6th layer: intermediate layer (IL-2) | |
| High boiling solvent (Oil-2) | 0.11 |
| Gelatin | 0.80 |
| 7th layer: low-speed green-sensitive layer | |
| Silver iodobromide emulsion (Em-1) | 0.20 |

-continued

| Sample 101 | |
|---|---|
| Silver iodobromide emulsion (Em-2) | 0.61 |
| Sensitizing dye (SD-4) | $7.4 \times 10^{-5}$ |
| Sensitizing dye (SD-5) | $6.6 \times 10^{-4}$ |
| Magenta coupler (M-1) | 0.18 |
| Magenta coupler (M-2) | 0.44 |
| Colored magenta coupler (CM-1) | 0.12 |
| High boiling solvent (Oil-2) | 0.75 |
| Gelatin | 1.95 |
| 8th layer: medium-speed green-sensitive layer | |
| Silver iodobromide emulsion (Em-3) | 0.87 |
| Sensitizing dye (SD-6) | $2.4 \times 10^{-4}$ |
| Sensitizing dye (SD-7) | $2.4 \times 10^{-4}$ |
| Magenta coupler (M-1) | 0.058 |
| Magenta coupler (M-2) | 0.13 |
| Colored magenta coupler (CM-1) | 0.070 |
| DIR compound (D-2) | 0.025 |
| DIR compound (D-3) | 0.002 |
| High boiling solvent (Oil-2) | 0.50 |
| Gelatin | 1.00 |
| 9th layer: high-speed green-sensitive layer | |
| Silver iodobromide emulsion (Em-5) | 1.27 |
| Sensitizing dye (SD-6) | $1.4 \times 10^{-4}$ |
| Sensitizing dye (SD-7) | $1.4 \times 10^{-4}$ |
| Magenta coupler (M-2) | 0.084 |
| Magenta coupler (M-3) | 0.064 |
| Colored magenta coupler (CM-1) | 0.012 |
| High boiling solvent (Oil-1) | 0.27 |
| High boiling solvent (Oil-2) | 0.12 |
| Gelatin | 1.0 |
| 10th layer: yellow filter layer | |
| Yellow colloidal silver | 0.08 |
| Antistain agent (SC-2) | 0.15 |
| High boiling solvent (Oil-2) | 0.19 |
| Gelatin | 1.10 |
| Formalin scavenger (HS-1) | 0.20 |
| 11th layer: intermediate layer | |
| Gelatin | 0.60 |
| Formalin scavenger (HS-1) | 0.20 |
| 12th layer: low-speed blue-sensitive layer | |
| Silver iodobromide emulsion (Em-1) | 0.11 |
| Silver iodobromide emulsion (Em-2) | 0.24 |
| Silver iodobromide emulsion (Em-3) | 0.11 |
| Sensitizing dye (SD-8) | $5.2 \times 10^{-4}$ |
| Sensitizing dye (SD-9) | $1.9 \times 10^{-5}$ |
| Yellow coupler (Y-1) | 0.65 |
| Yellow coupler (Y-2) | 0.17 |
| High boiling solvent (Oil-2) | 0.16 |
| Gelatin | 1.25 |
| 13th layer: high-speed blue-sensitive layer | |
| Silver iodobromide emulsion (Em-3) | 0.13 |
| Silver iodobromide emulsion (Em-4) | 0.81 |
| Sensitizing dye (SD-8) | $1.8 \times 10^{-4}$ |
| Sensitizing dye (SD-9) | $7.9 \times 10^{-5}$ |
| Yellow coupler (Y-1) | 0.18 |
| High boiling solvent (Oil-2) | 0.071 |
| Gelatin | 1.30 |
| 14th layer: 1st protective layer | |
| Fine grain silver iodobromide emulsion (average grain size: 0.08 μm, AgI content: 1 mol %) | 0.4 |
| UV absorbent (UV-1) | 0.07 |
| UV absorbent (UV-2) | 0.10 |
| High boiling solvent (Oil-1) | 0.07 |
| High boiling solvent (Oil-3) | 0.07 |
| Formalin scavenger (HS-1) | 0.40 |
| Gelatin | 1.31 |
| 15th layer: 2nd protective layer | |
| Alkali-soluble matting agent (average particle size: 2 μm) | 0.15 |
| Polymethylmethacrylate (average particle size: 3 μm) | 0.04 |
| Slipping agent (WAX-1) | 0.04 |
| Gelatin | 0.55 |

Besides the above compositions, coating aid Su-1, dispersant Su-2, viscosity regulator, hardeners H-1 and H-2, stabilizer ST-1, antifoggants AF-1 and AF-2 (weight average molecular weights were 10,000 and 1,100,000, respectively), and antiseptic DI-9 (9.4 mg/m$^2$) were added.

Contents of emulsions Em-1 to Em-5 are shown in the following table, where the average grain size is given as a diameter of a converted sphere. Each emulsion was subjected to an optimum chemical sensitization by use of gold and sulfur compounds.

TABLE 2

| Emulsion No. | Average Silver Iodide Content (mol %) | Average Grain Size (μm) | Crystal Habit |
|---|---|---|---|
| Em-1 | 2 | 0.3 | octahedron |
| Em-2 | 8 | 0.4 | octahedron |
| Em-3 | 8 | 0.7 | twin |
| Em-4 | 9 | 0.9 | twin |
| Em-5 | 8 | 0.9 | twin |

The chemical structures of the compounds used are shown below.

C-1

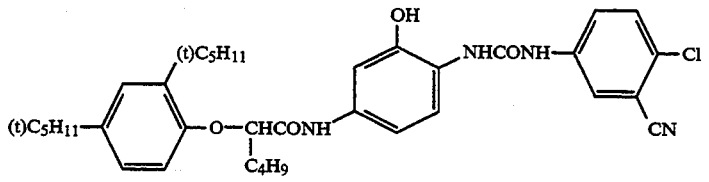

C-2

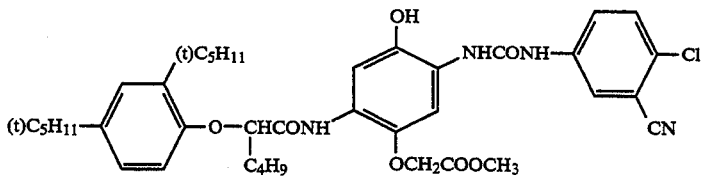

M-1

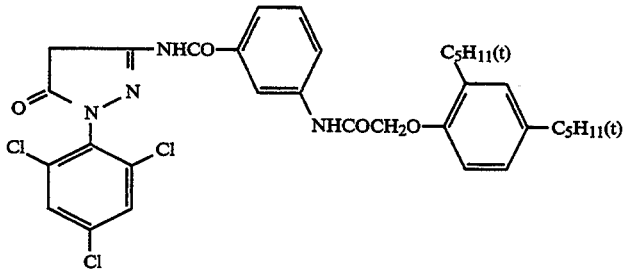

M-2

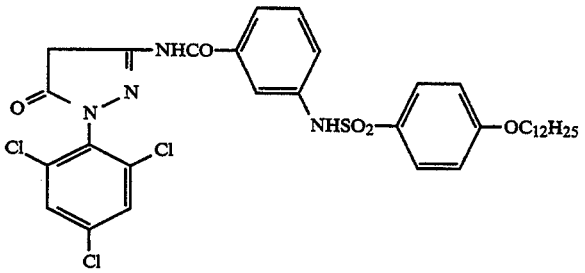

M-3

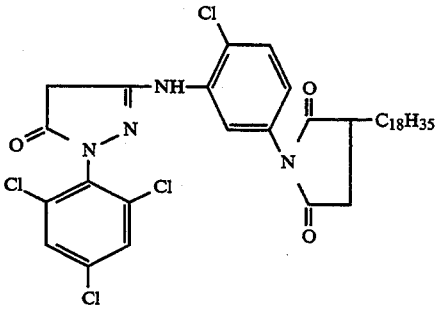

-continued
Y-1
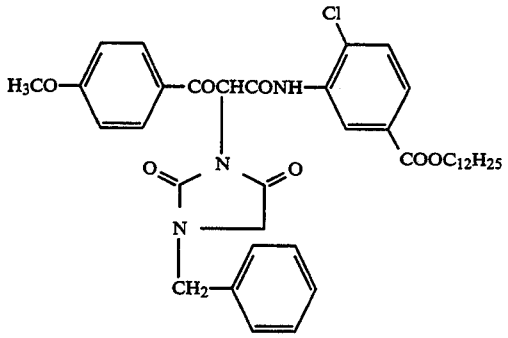
CC-1
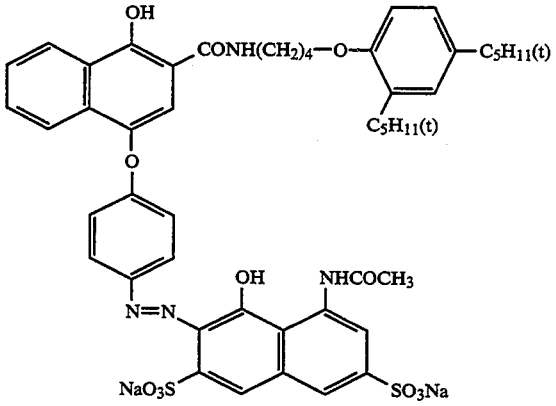
CM-1
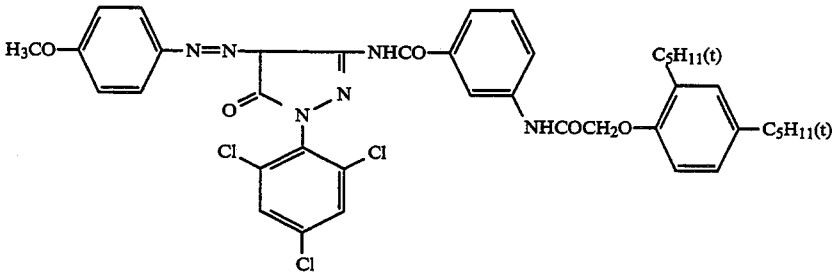
D-1
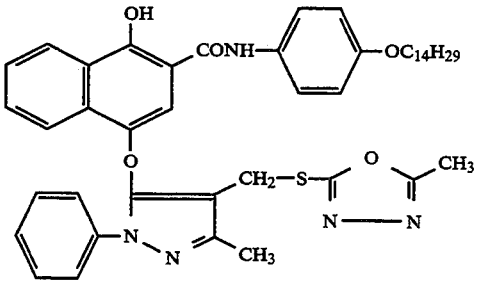

-continued
D-2
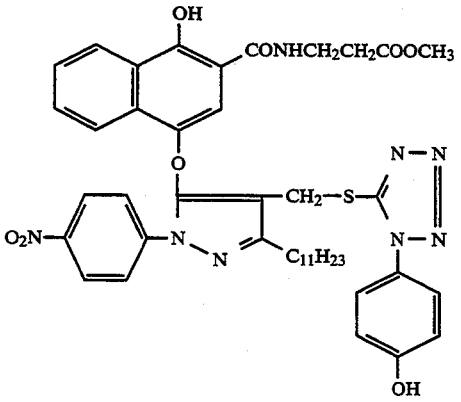
D-3
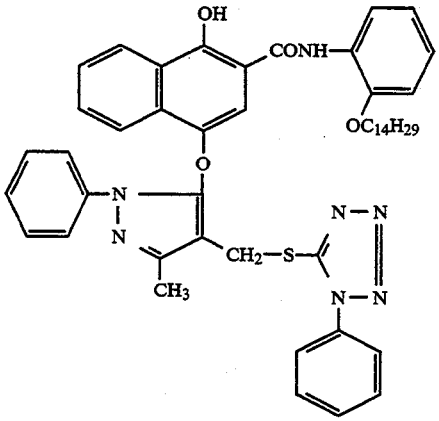
Oil-1
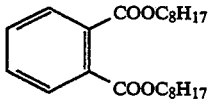
Oil-2
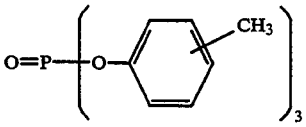
Oil-3
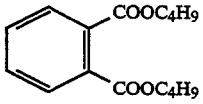
SC-2
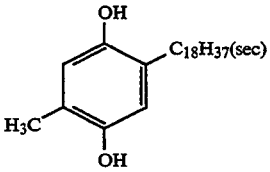
UV-1
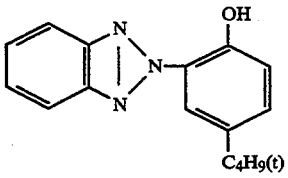

-continued
UV-2
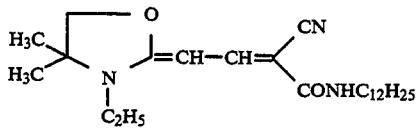
WAX-1
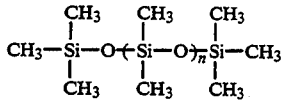
Mw = 3,000 (weight-average molecular weight)
Su-1
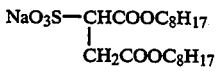
Su-2
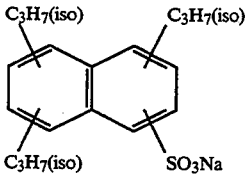
HS-1
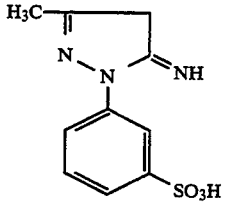
SD-1
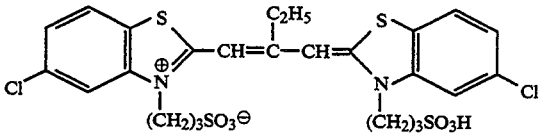
SD-2
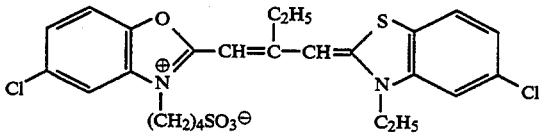
SD-3
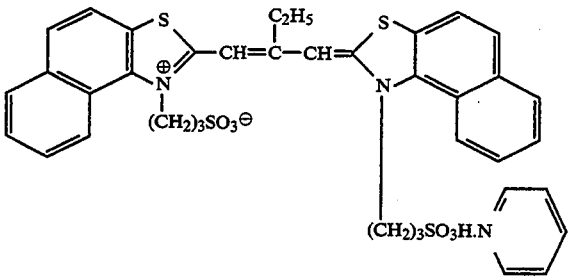
SD-4
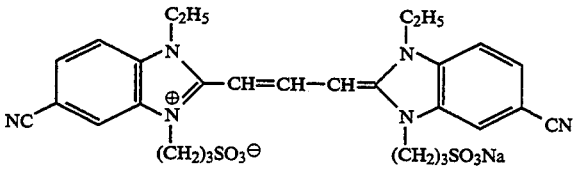
SD-5
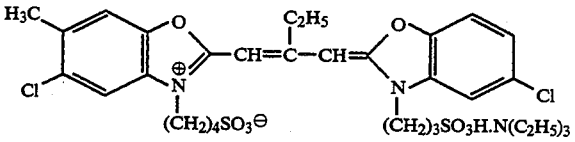

-continued
SD-6
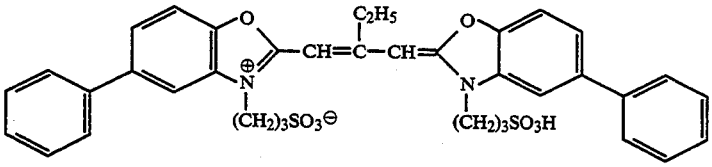
SD-7
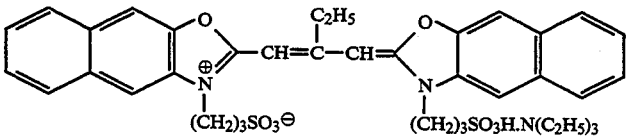
SD-8
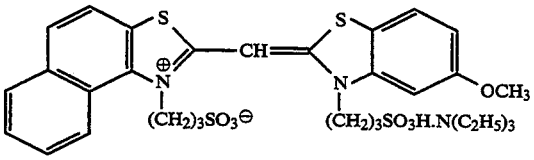
SD-9
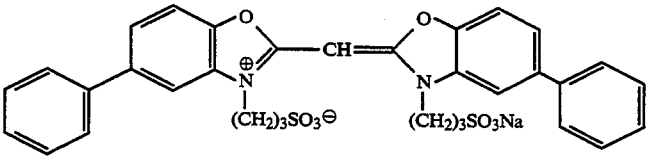
H-1
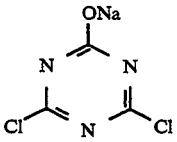
$(CH_2{=}CHSO_2CH_2)_2O$
H-2
ST-1
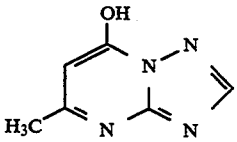
AF-1
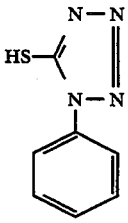
AF-2
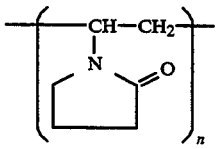
n: (degree of polymerization)

-continued component A component B component C

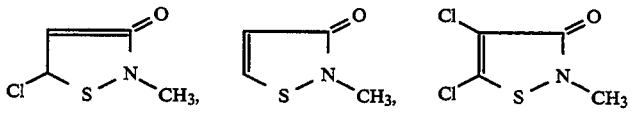

component A:B:C = 50:46:4 (mole ratio)

Sample 102 was prepared by forming one blue-sensitive layer in addition to the 12th and 13th layers of sample 101. Further, samples 103 to 107 were prepared by varying the silver iodide content in the highest speed blue-sensitive layer and the lowest speed blue-sensitive layer as shown in Table 3.

The silver iodobromide emulsion used in the high-speed blue-sensitive layer was prepared in the following procedure: (Preparation of Comparative Emulsion)

Preparation of Spherical Grain Seed Emulsion

A monodispersed spherical grain seed emulsion was prepared by use of the following solutions $A_1$ to $D_1$ according to the method described in Japanese Pat. O.P.I. Pub. No. 6643/1986.

| | | |
|---|---|---|
| $A_1$ | Ossein gelatin | 150 g |
| | Potassium bromide | 53.1 g |
| | Potassium iodide | 24 g |
| | Water is added to make 7.2 1. | |
| $B_1$ | Silver nitrate | |
| | Water is added to make 6 1. | 1500 g |
| | Potassium bromide | |
| | $C_1$1-Phenyl-5-mercaptotetrazole (dissolved in methanol) | 0.3 g |
| | Water is added to make 3 1. | |
| $D_1$ | Aqueous ammonia (28%) | 705 ml |

While stirring solution $A_1$ vigorously at 40° C. solutions $B_1$ and $C_1$ were added thereto in 30 seconds by the double jet method to form nucleus. The pBr during the addition was maintained at 1.09 to 1.15.

One minute and thirty seconds later, solution $D_1$ was added in 20 seconds, followed by a 5-minute ripening at a KBr concentration of 0.071 mol/l and an ammonia concentration of 0.63 mol/l.

Then, the pH was adjusted to 6.0, and the resulting seed emulsion was subjected to desalting and washing.

An electron microscopic observation of the seed emulsion proved that the emulsion was a monodispersed emulsion comprising spherical grains having an average grain size of 0.36 μm and a grain size distribution extent of 18%.

Preparation of Emulsion

An emulsion having an average silver iodide content of 8.0 mol % was prepared according to the following procedure:

| | | |
|---|---|---|
| $A_3$ | Ossein gelatin | 76.8 g |
| | Potassium bromide | 3.0 g |
| | Disodium propyleneoxy polyethyleneoxy disuccinate (10% methanol solution) | 10 ml |
| | Spherical grain seed emulsion (described above) | |
| | Nitric acid (S.G.: 1.38) equivalent to 0.191 mole | |
| | Water is added to make | 4.0 l |
| $B_{3-1}$ | Silver nitrate | 194.5 9 |
| | Nitric acid (S.G.: 1.38) | 4.1 ml |

-continued

| | | |
|---|---|---|
| | Water is added to make | 1309 ml |
| $C_{3-1}$ | Ossein gelatin | 52.4 g |
| | Potassium bromide | 95.4 g |
| | Potassium iodide | 57.0 g |
| | Water is added to make | 1309 ml |
| $B_{3-2}$ | Silver nitrate | 195.4 g |
| | Nitric acid (S.G.: 1.38) | 2.0 ml |
| | Water is added to make | 575 ml |
| $C_{3-2}$ | Ossein gelatin | 23.0 g |
| | Potassium bromide | 116.3 g |
| | Potassium iodide | 28.6 g |
| | Water is added to make | 575 ml |
| $B_{3-3}$ | Silver nitrate | 777.6 g |
| | Nitric acid (S.G.: 1.38) | 8.1 ml |
| | Water is added to make | 2289 ml |
| $C_{3-3}$ | Ossein gelatin | 91.6 g |
| | Potassium bromide | 539.4 g |
| | Potassium iodide | 7.60 g |
| | Water is added to make | 2289 ml |

The apparatus described in Japanese Pat. O.P.I. Pub. No. 160128/1987 was used. Prior to the addition of the above solutions, each of the six nozzles were attached to the apparatus for both of the group of solutions $B_3$ ($B_{3-1}$ to $B_{3-3}$, switched for each solution) and the group of solutions $C_3$ ($C_{3-1}$to $C_{3-3}$, switched for each solution), so as to feed each solution beneath the stirring blade in six portions.

While stirring solution $A_3$ at 450 rpm keeping the temperature at 75° C., solution $B_{3-1}$ and solution $C_{3-1}$ were added by a double jet method started with the addition at an initial flow rate of 11.62 ml/min and ended with the addition at a final flow rate of 25.63 ml/min. During the addition, the flow rate was linearly raised against the addition time, the pAg was kept at 8.2.

After the addition of solution B3-1 and solution C3-1, the pAg was adjusted to 8.45 with a 3.5 N potassium bromide aqueous solution, then the stirring rate was raised to 500 rpm.

Then, addition of solution $B_{3-2}$ and solution $C_{3-2}$ to the solution kept in stirring was made by a double jet method started with the addition at an initial flow rate of 15.59 ml/min and ended with the addition at a final flow rate of 18.51 ml/min. During the addition, the flow rate was raised linearly against the addition time, and the pAg was kept at 8.45. After completion of the addition, the stirring was intensified to 550 rpm.

While the solution was being stirred, solution $B_{3-3}$ and solution $C_{3-3}$ were added thereto by a double jet method started with the addition at an initial flow rate of 41.19 ml/min. During the addition, the flow rate was raised linearly against the addition time, and the pAg was kept at 8.45.

After completing the addition, the pH was adjusted to 6.0 with a 1.78 N potassium hydroxide aqueous solution, then the grains formed were desalted in the usual manner.

According to an electron microscopic observation, the resultant emulsion comprised silver halide grains having an average size of 1.27 μm and a grain size distribution extent of 13.7%. And these twinned crystal grains bearing an even number of twin planes had an average grain-size/grain-thickness ratio of 3.1.

Samples 108 and 109 were prepared by changing the production method of the silver iodobromide emulsion for high-speed blue-sensitive layers contained in samples 104 and 107, respectively, as described below.

Preparation of Emulsion of the Invention

Preparation of Spherical Seed Grains

A monodispersed spherical grain seed emulsion was prepared in the following procedure:

| | | |
|---|---|---|
| A | Ossein gelatin | 80 g |
| | Potassium bromide | 47.4 g |
| | Disodium Polyisopropylene-polyethyleneoxy-disuccinate (10% methanol solution) | 20 ml |
| | Water is added to make | 8000 ml |
| B | Silver nitrate | 1200 g |
| | Water is added to make | 1600 ml |
| C | Ossein gelatin | 32.2 g |
| | Potassium bromide | 840 g |
| | Water is added to make | 1600 ml |
| D | Aqueous ammonia | 470 ml |

Solution B and solution C were added to solution A being stirred at 40° C. in 11 minutes by the double jet method to form nuclei, during which the pBr was kept at 1.60.

Then, the temperature was lowered to 30° C. in 12 minutes, and ripening was continued for another 18 minutes.

Subsequently, solution D was added in 1 minute, followed by a 5-minute ripening at a KBr concentration of 0.07 mol/l and an ammonia concentration of 0.63 mol/l.

After the ripening, the liquor was adjusted to a pH of 6.0 and then subjected to desalting in the usual manner. An electron microscopic observation proved that the resulting seed emulsion comprised spherical grains having an average size of 30 μm and two twin planes parallel to each other.

Preparation of Emulsion of the Invention A monodispersed octahedral twinned grain emulsion related to the invention was prepared by use of the following 7 solutions.

| | |
|---|---|
| Solution A | |
| Ossein gelatin | 268.2 g |
| Deionized water | 4000 ml |
| Disodium Polyisopropylene-polyethyleneoxy-disuccinate (10% methanol solution) | 1.5 ml |
| Spherical grain seed emulsion (described above) | 0.286 ml |
| Aqueous ammonia (28 wt %) | 528.0 ml |
| Acetic acid (58 wt % aqueous solution) | 795.0 ml |
| Methanol solution containing 0.001 mole of iodine | 50.0 ml |
| Deionized water is added to make | 5390.0 ml |

Solution B 3.5N Ammoniacal silver nitrate solution (pH was adjusted to 9.0 with ammonium nitrate)

Solution C 3.5N Potassium bromide aqueous solution containing 4.0 wt. % gelatin

Solution D

Fine grain emulsion comprising 3 wt. % gelatin and silver iodide grains (average size:0.05 μm) 2.39 mol This fine grain emulsion was prepared by steps of adding 2000 ml each of an aqueous solution containing 7.06 moles of silver nitrate and an aqueous solution containing 7.06 moles of to 5000 ml of a 6-wt. % gelatin solution containing 0.06 mole of potassium iodide over a period of 10 minutes, while keeping the pH at 2.0 with nitric acid and the temperature at 40° C. and, after the formation of nuclei, adjusting the pH to 6.0 with a sodium carbonate aqueous solution.

Solution E

Fine grain emulsion comprising silver iodobromide grains (average size: 0.04 μm) containing 1 mol % silver iodide 6.24 mol This emulsion was prepared in the same way as in the silver iodide fine grain emulsion of solution D, the temperature was kept at 30° C. during the formation of fine grains.

Solution F 1.75N Potassium bromide aqueous solution

Solution G

Acetic acid aqueous solution (56 wt. %)

To solution A kept at 40° C. in a reaction vessel were added solution B, solution C and solution D by the double Jet method over a period of 163 minutes. Then, solution E was added thereto over a period of 12 minutes at a constant rate, so that seed grains were grown to 1.0 μm (in terms of diameter of a sphere).

During the addition, the addition rate of solution B and solution C was varied, as a function of the addition time, correspondingly to the critical growth rate, so that the addition rate was properly controlled not to allow the formation of small grains other than seed grains and not to cause polydispersion by the Ostwald ripening. The ratio (mole ratio) of the addition rate of solution D, a silver iodide grain emulsion, to that of the ammoniacal silver nitrate solution was varied against the grain size (the addition time) as shown in Table 3, so as to prepare a core/shell type silver halide emulsion comprising multilayered grains.

With solutions F and G, the pAg and pH were controlled during the growth of crystal grains. Measurements of the pAg and pH were made in the usual manner using a silver sulfide electrode and a glass electrode.

After the formation of grains, desalting was carried out according to the method disclosed in Japanese Pat. Appl. No. 41314/1991, followed by redispersing by use of gelatin. Then, the emulsion obtained was adjusted to pH 5.80 and pAg 8.06 at 40° C.

It was confirmed from a scanning electron microscopic photograph of the emulsion grain that the emulsion comprised monodispersed octahedral twinned crystal grains having an average size of 1.0 μm (diameter of a converted sphere) and a grain size distribution extent of 10.3%.

TABLE 3

| | Addition Time (min) | Grain Size (μm) | Flow Ratio of Solution D | pH | pAg |
|---|---|---|---|---|---|
| Core portion | 0.0 | 0.300 | 10.3 | 7.2 | 7.8 |
| | 23.1 | 0.423 | 10.3 | 7.2 | 7.8 |
| | 38.1 | 0.489 | 10.3 | 7.2 | 7.8 |

TABLE 3-continued

| | Addition Time (min) | Grain Size (μm) | Flow Ratio of Solution D | pH | pAg |
|---|---|---|---|---|---|
| | 50.1 | 0.533 | 30.0 | 7.2 | 7.8 |
| | 82.6 | 0.654 | 30.0 | 7.2 | 7.8 |
| Shell portion | 82.6 | 0.654 | 30.0 | 6.5 | 9.4 |
| | 122.7 | 0.704 | 10.3 | 6.5 | 9.4 |
| | 122.0 | 0.721 | 10.3 | 6.5 | 9.4 |
| | 141.6 | 0.780 | 7.7 | 6.5 | 9.4 |
| | 141.6 | 0.780 | 0.0 | 6.5 | 9.4 |
| | 163.0 | 0.792 | 0.0 | 6.5 | 9.7 |

TABLE 4

| | Blue-sensitive Layer | | | | |
|---|---|---|---|---|---|
| Sample No. | Number of Layers | Silver Iodide Content (A) in the Highest Speed Layer | Silver Iodide Content (B) in the Lowest Speed Layer | Difference (A) − (B) | Remarks |
| 101 | 2 | 8.0 | 7.8 | 0.2 | Comparison |
| 102 | 3 | 13.2 | 5.9 | 7.6 | Comparison |
| 103 | 3 | 14.0 | 8.5 | 5.5 | Invention |
| 104 | 3 | 8.1 | 7.8 | 0.3 | Invention |
| 105 | 3 | 14.0 | 4.0 | 10 | Comparison |
| 106 | 3 | 1.5 | 3.0 | −1.5 | Comparison |
| 107 | 3 | 8.0 | 4.5 | 3.5 | Invention |
| 108 | 3 | 8.1 | 7.8 | 0.3 | Invention |
| 109 | 3 | 8.0 | 4.5 | 3.5 | Invention |

| | |
|---|---|
| 12th layer: low-speed blue-sensitive layer | |
| Silver iodobromide emulsion, (average grain size: 0.35 μm, octahedral, silver iodide content: 5.9 mol %) | 0.25 |
| Sensitizing dye (SD-8) | $4.9 \times 10^{-4}$ |
| Yellow coupler (Y-1) | 0.75 |
| DIR compound (D-1) | 0.010 |
| High boiling solvent (Oil-2) | 0.30 |
| Gelatin | 1.20 |
| 13th layer: medium-speed blue-sensitive layer | |
| Silver iodobromide emulsion (average grain size: 0.55 μm, octahedral, silver iodide content: 8.0 mol %) | 0.30 |
| Sensitizing dye (SD-8) | $1.6 \times 10^{-4}$ |
| Sensitizing dye (SD-9) | $7.2 \times 10^{-5}$ |
| Yellow coupler (Y-1) | 0.10 |
| High boiling solvent (Oil-2) | 0.04 |
| Gelatin | 0.47 |
| 14th layer: high-speed blue-sensitive layer | |
| Silver iodobromide emulsion (average grain size: 0.92 μm, twinned grain, silver iodide content: 13.2 mol%) | 0.85 |
| Sensitizing dye (SD-8) | $7.3 \times 10^{-4}$ |
| Sensitizing dye (SD-9) | $2.8 \times 10^{-5}$ |
| Yellow coupler (Y-1) | 0.15 |
| High boiling solvent (Oil-2) | 0.06 |
| Gelatin | 0.80 |
| 15th layer: 1st protective layer | |
| Fine grain silver iodobromide emulsion (average grain size: 0.08 μm, silver iodide content: 1 mol %) | 0.4 |
| UV absorbent (UV-1) | 0.065 |
| UV absorbent (UV-2) | 0.10 |
| High boiling solvent (Oil-1) | 0.07 |
| High boiling solvent (Oil-3) | 0.07 |
| Formalin scavenger (HS-1) | 0.40 |
| Gelatin | 1.31 |
| 16th layer: 2nd protective layer | |
| Alkali-soluble matting agent (average particle size: 2 μm) | 0.15 |
| Polymethylmethacrylate (average particle size: 3 μm) | 0.04 |
| Slipping agent (WAX-1) | 0.04 |
| Gelatin | 0.55 |

Samples 101 to 107 so-prepared were exposed to white light through an optical wedge and then processed in the following processes (A) and (B):

| | Process (A) | | |
|---|---|---|---|
| Process | Processing Time | Processing Temp. | Replenishing* Amount |
| Color developing | 3 min 15 sec | 38 ± 0.3° C. | 780 ml |
| Bleaching | 45 sec | 38 ± 2.0° C. | 150 ml |
| Fixing | 1 min 30 sec | 38 ± 2.0° C. | 830 ml |
| Stabilizing | 60 sec | 38 ± 5.0° C. | 830 ml |
| Drying | 1 min | 55 ± 5.0° C. | — |

*Replenishing amounts are given in values per 1 $m^2$.

The color developer, bleach, fixer, stablizer, and replenishers thereof used are described below.

| Color developer | |
|---|---|
| Water | 800 ml |
| Potassium carbonate | 30 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxyethyl)-aniline sulfate | 4.5 g |
| Diethylenetriaminepentacetic acid | 3.0 g |
| Potassium hydroxide | 1.2 g |

Water added to make 1 liter, and the pH adjusted to 10.06 with potassium hydroxide or sulfuric acid.

| Color developing replenisher | |
|---|---|
| Water | 800 ml |
| Potassium carbonate | 35 g |
| Sodium hydrogencarbonate | 3 g |
| Potassium sulfite | 5 g |
| Sodium bromide | 0.4 g |
| Hydroxylamine sulfate | 3.1 g |
| 4-Amino-3-methyl-N-ethyl-N-(β-hydroxyethyl)-aniline sulfate | 6.3 g |
| Potassium hydroxide | 2 g |
| Diethylenetriaminepentacetic acid | 3.0 g |

Water added to make 1 liter, and the pH adjusted to 10.18 with potassium hydroxide or sulfuric acid.

| Bleach | |
|---|---|
| Water | 700 ml |
| Ammonium ferric 1,3-diaminopropanetetracetate | 125 g |
| Ethylenediaminetetracetic acid | 2 g |
| Sodium nitrate | 40 g |

-continued

| | |
|---|---|
| Ammonium bromide | 150 g |
| Glacial acetic acid | 40 g |

Water added to make 1 liter, and the pH adjusted to 4.4 with aqueous ammonia or glacial acetic acid.

| Bleaching replenisher | |
|---|---|
| Water | 700 ml |
| Ammonium ferric 1,3-diaminopropanetetracetate] | 175 g |
| Ethylenediaminetetracetic acid | 2 g |
| Sodium nitrate | 50 g |
| Ammonium bromide | 200 g |
| Glacial acetic acid | 56 g |

The pH adjusted to 4.4 with aqueous ammonia or glacial acetic acid, then water is added to make 1 liter.

| Fixer | |
|---|---|
| Water | 800 ml |
| Ammonium thiocyanate | 120 g |
| Ammonium thiosulfate | 150 g |
| Sodium sulfite | 15 g |
| Ethylenediaminetetracetic acid | 2 g |

After adjusting the pH to 6.2 with aqueous ammonia or glacial acetic acid, water is added to make 1 liter.

| Fixing replenisher | |
|---|---|
| Water | 800 ml |
| Ammonium thiocyanate | 150 g |
| Ammonium thiosulfate | 180 g |
| Sodium sulfite | 20 g |
| Ethylenediaminetetracetic acid | 2 g |

After adjusting the pH to 6.5 with aqueous ammonia or glacial acetic acid, water is added to make 1 liter.

| Stabilizer and stabilizing replenisher | |
|---|---|
| Water | 900 ml |
| p-Octylphenyl-polyethyleneoxide-ether (10 mol ethylene oxide adduct) | 2.0 g |
| Dimethylolurea | 0.5 g |
| Hexamethylenetetramine | 0.2 g |
| 1,2-Benzisothiazoline-3-one | 0.1 g |
| Siloxane (L-77 made by Union Carbide Corp.) | 0.1 g |
| Aqueous ammonia | 0.5 ml |

Water is added to make 1 liter, then the pH is adjusted to 8.6 with aqueous ammonia or 50% sulfuric acid.

At the same time, color images were formed by processing the samples according to process (B), which was the same as process (A) except that the color developing process and the color developer were changed as follows:

| Process (B) | | |
|---|---|---|
| Color developing | 40° C. | 90 sec |
| Color developer composition: | | |
| 4-Amino-3-methyl-N-ethyl-N-(β-hydroxyethyl)-aniline sulfate | | 11.1 g |
| Anhydrous sodium sulfite | | 4.25 g |
| Hydroxylamine ½ sulfate | | 2.0 g |
| Anhydrous potassium carbonate | | 30.0 g |
| Sodium bromide | | 1.3 g |
| Trisodium nitrilotriacetate (monohydrate) | | 2.5 g |

-continued

| | |
|---|---|
| Potassium hydroxide | 1.0 g |

Water was added to make 1 liter (pH=10.2).

The color images obtained in process (A) were evaluated for the relative sensitivity, graininess and processing variance as shown in Table 5. The relative sensitivity in the table is given by a relative value of the reciprocal of an exposure to give a density of fog+0.3. The graininess is indicated by RMS values at points which have densities of fog+0.4 and fog+0.7, respectively.

The RMS value is obtained by scanning the density of measured portion of a sample with a microdensitometer having an aperture scanning area of 1800 $\mu m^2$ (slit width: 10 $\mu m$, slit length: 180 $\mu m$) and determining the thousandfold value of the standard deviation of variations in densities of at least 1000 densitimetry sampling numbers, which is shown by a value relative to the RMS value of sample 101 which is set at 100.

The processing variance is indicated as a y ratio obtained from an equation of (slope of a characteristic curve in process (B)/slope of a characteristic curve in process (A)). Accordingly, it is preferable that the value be as close as possible to 1.

TABLE 5

| | Blue-sensitive Layer | | | | |
|---|---|---|---|---|---|
| | | RMS | | Processing | |
| Sample No. | Sensitivity | +0.4 | +0.7 | variance | Remarks |
| 101 | 100 | 100 | 100 | 1.2 | comparison |
| 102 | 103 | 88 | 85 | 1.21 | comparison |
| 103 | 104 | 86 | 75 | 1.10 | invention |
| 104 | 101 | 83 | 73 | 1.08 | invention |
| 105 | 104 | 84 | 85 | 1.23 | comparison |
| 106 | 85 | 90 | 88 | 1.22 | comparison |
| 107 | 100 | 85 | 78 | 1.09 | invention |
| 108 | 101 | 83 | 74 | 1.06 | invention |
| 109 | 100 | 84 | 77 | 1.08 | invention |

As apparent from the above results, the samples of the invention were improved in processing variance and graininess. Much the same processing variances were obtained in other evaluations made in similar manners on green-sensitive layers and red-sensitive layers.

What is claimed is:

1. A silver halide color photographic light-sensitive material comprising a support having thereon a silver halide red-sensitive layer, a silver halide green-sensitive layer and a silver halide blue-sensitive layer, wherein said blue-sensitive layer comprises three or more silver halide emulsion layers including a layer having the highest sensitivity and a layer having the lowest sensitivity, wherein the difference between the average silver iodide content of said emulsion contained in the highest sensitivity layer of said blue-sensitive layers and the average silver iodide content of said emulsion contained in the lowest sensitivity layer of said blue-sensitive layers is represented by Equation 1, and the sum total of the silver halides contained in said silver halide color light-sensitive material is within the range of 4.0 to 8.0 g/$m^2$ in terms of metal silver;

Equation 1

Average silver iodide content of the highest sensitivity layer) −(average silver iodide content of the lowest sensitivity layer)

is 0 to 4.5 mol %; and wherein each of the red, green and blue silver halide emulsions comprise a monodispersed silver halide emulsion comprising substantially twin silver halide grains.

2. The material of claim 1, wherein in each of said red, green and blue silver halide emulsions, 60% or more in terms of a total projected area comprises said twin silver halide grains having a diameter to thickness ratio of 1 to 20.

3. The material of claim 1, wherein in each of said red, green and blue silver halide emulsions, 60% or more in terms of a total projected area comprises said twin silver halide grains having a diameter to thickness ratio of 1.2 to 8.

4. The material of claim 1, wherein each of said red, green and blue silver halide emulsions comprise silver halide grains having a high silver iodide content phase, wherein the silver iodide content of said high silver iodide content phase is within the range of 15 to 45 mol %.

5. A silver halide color photographic light-sensitive material comprising a support having thereon a silver halide red-sensitive layer, a silver halide green-sensitive layer and a silver halide blue-sensitive layer, wherein said blue-sensitive layer comprises three or more silver halide emulsion layers including a layer having the highest sensitivity and a layer having the lowest sensitivity, wherein the difference between the average silver iodide content of said emulsion contained in the highest sensitivity layer of said blue-sensitive layers and the average silver iodide content of said emulsion contained in the lowest sensitivity layer of said blue-sensitive layers is represented by Equation 1, and the sum total of the silver halides contained in said silver halide color light-sensitive material is within the range of 3.5 to 8.5 $g/m^2$ in terms of metal silver;

Equation 1

(Average silver iodide content of the highest sensitivity layer) —(average silver iodide content of the lowest sensitivity layer)

is 0 to 4 mol %; and wherein each of the red, green and blue silver halide emulsions comprise a monodispersed silver halide emulsion comprising substantially twin silver halide grains.

* * * * *